United States Patent [19]

Burchall

[11] 4,168,477

[45] Sep. 18, 1979

[54] ELECTRIC REGULATORS

[75] Inventor: Malcolm A. Burchall, Wendens Ambo, England

[73] Assignee: Gould Advance Limited, Essex, England

[21] Appl. No.: 879,958

[22] Filed: Feb. 21, 1978

[51] Int. Cl.[2] ..... G05F 1/44

[52] U.S. Cl. ..... 323/23; 323/24

[58] Field of Search ..... 307/98, 100, 104, 106, 307/252 Q, 252 T; 315/247, 253, 258, 265, 283, 287; 323/7, 8, 23, 24, 25, 119, DIG. 1; 328/21

[56] References Cited

U.S. PATENT DOCUMENTS

| | | | |
|---|---|---|---|
| 3,906,337 | 9/1975 | Depenbrock | 323/119 X |
| 3,913,002 | 10/1975 | Steigerwald et al. | 323/DIG. 1 |
| 3,958,131 | 5/1976 | Mozdzer | 323/24 X |

FOREIGN PATENT DOCUMENTS

| | | | |
|---|---|---|---|
| 1563314 | 4/1970 | Fed. Rep. of Germany | 307/252 Q |
| 409209 | 6/1974 | U.S.S.R. | 323/24 |
| 488197 | 2/1976 | U.S.S.R. | 323/17 |

OTHER PUBLICATIONS

Mattson, "High-Frequency Power Supply," IBMTDB, vol. 15, No. 10, Mar. 1973, pp. 3175-3176.

*Primary Examiner*—A. D. Pellinen

*Attorney, Agent, or Firm*—Lawrence E. Laubscher

[57] ABSTRACT

An alternating-current voltage regulator including a pair of input terminals adapted for connection with an alternating current supply voltage, a pair of output terminals adapted for connection with a load, a series-connected first switching device, a parallel-connected second switching device, an inductor connected in series with the first switching device, and a control device connected between the regulator output terminals and the switching devices for switching the switching devices at a second frequency which is high with respect to the frequency of the supply voltage. Consequently, a quantity of energy stored in the inductance during one part of a cycle of the second frequency is transferred to the output as an increase in voltage of the output with respect to the input during another part of the cycle.

6 Claims, 8 Drawing Figures

ELECTRIC REGULATORS

BACKGROUND OF THE INVENTION

This invention relates to electric regulators of the type which receive an alternating (AC) input and produce a regulated AC output. More specifically, the invention relates to a regulator of this type in which regulation is effected by means of high frequency switching devices. In this context, the term high frequency is to be taken as meaning higher, preferably by a factor of several times or more, than the fundamental frequency of the input AC voltage.

AC voltage regulators are known wherein regulation by high frequency switching devices produces an output voltage which is less than the input voltage. One such circuit is disclosed in U.K. Patent No. 1,045,002. However, if it is required to produce an output voltage which is greater than the input voltage using such a circuit, a step-up transformer must be provided at either the input or the output to the circuit. Such a transformer will add considerably to the size and weight of the regulator. If the power handled by the circuit is at all significant, the transformer will also be expensive to produce and introduce a considerable power loss due to the resistance of its windings. A regulator producing a boost in voltage without utilizing a transformer can consequently be much lighter, more compact and less expensive to manufacture. In addition, the efficiency of the regulator will be greatly increased due to the absence of a transformer to cause power losses.

SUMMARY OF THE INVENTION

The present invention provides an electric regulator comprising an input connected to a source of an AC signal at a first frequency, an output for a regulated AC signal at said frequency, switching means connected in series and in parallel between said input and said output, and means for controlling the switching means connected to said output and to said switching means for switching the switching means at a second frequency which is high with respect to said first frequency and for controlling the ratio of the periods of time for which said switching means is turned on and turned off in response to a parameter of the output of the regulator. The improvement provided by the invention comprises an inductance connected in series between the input and the switching means such that a quantity of energy stored in the inductance during one part of a cycle of the switching frequency is transferred to the output as an increase in voltage of the output with respect to the input during another part of the switching cycle.

DESCRIPTION OF THE DRAWINGS

In order that the present invention be more readily understood, an embodiment thereof will now be described, by way of example, with reference to the accompanying drawings, in which.

DESCRIPTION OF PREFERRED EMBODIMENT

Figure 1:
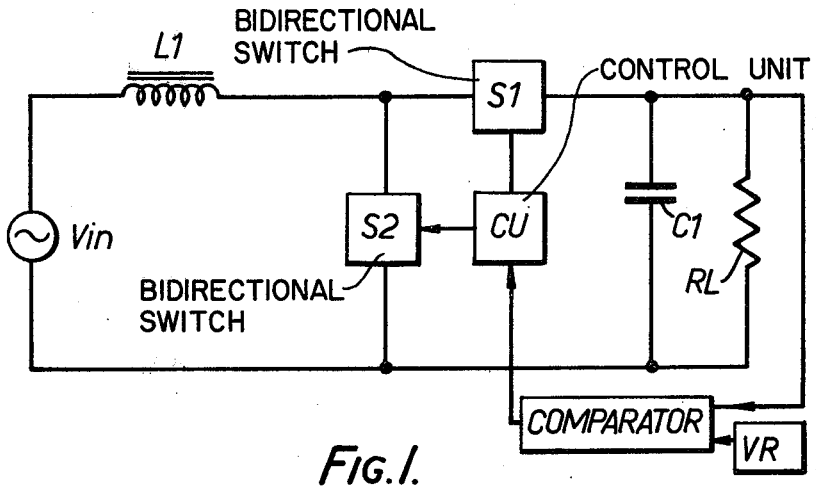
FIG. 1 is a block diagram of a regulator.

In FIG. 1 $V_{in}$ is an AC source of power, L1 is an inductor, S1 and S2 are bi-directional switches and C1 is an integrating capacitor feeding into an AC load RL; the load can have any power factor from zero leading through unity to zero lagging. The switching devices S1 and S2 can consist of any suitable control devices such as transistors or combinations of transistors, gate turn off thyristors, thyristors with commutation circuits, and the like. The switching devices are operated in synchronism by a control unit CU, such that when switching device S1 is open, S2 is closed and vice-versa, and the switching times of the switching devices are controlled in such manner that the relative durations of the switching times can be varied. Conveniently and preferably the frequency of switching, and hence the switching cycle time, is held constant and the mark-space ratios of the switching control voltages are altered. For the purpose of control to achieve any desired relationship between input and output voltages with the output voltage greater or equal to the input voltage, the control unit can be made responsive to any variables in respect of which the regulated voltage or current is to be a function.

The circuit operates in the following manner. S2 is closed, and the current in L1 increases until it is above the quiescent level demanded by the load. At some time after this S2 is opened and S1 is simultaneously closed. The inductive action of L1 now transfers the current from S2 through S1 into the capacitor C1 and the load RL. Since this current is larger than that demanded by the load the surplus charges up C1 and the output voltages rises. By definition, since this is a voltage boost circuit, the output voltage is higher than the input voltage therefore a counter-e.m.f. now exists across L1 and the current in it starts to reduce. At some later time after the current in the inductor has fallen to below that demanded by the load, the extra current to the load is provided by C1 and the output voltage falls. S2 is then again closed and S1 is opened simultaneously; the current in L1 now starts to rise again and the cycle repeats. During the interval when S1 is opened the load current is provided by C1.

Figure 2A:
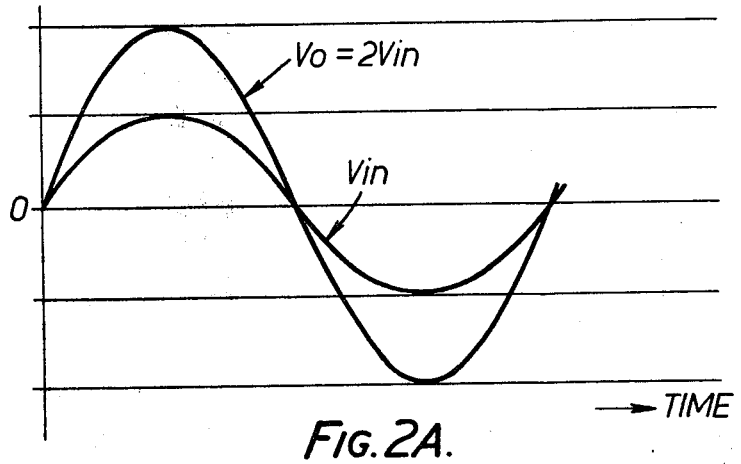
FIGS. 2A, 2B, 3A and 3B are waveform diagrams.
Figure 2B:
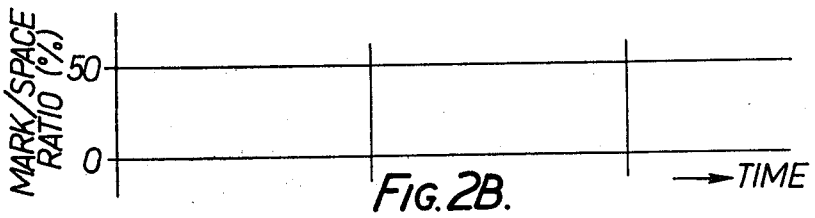

By controlling the respective ratios of off to on periods of the switches S1 and S2 it is possible to make the output voltage Vo of any desired value, in excess of the input voltage $V_{in}$. For example, for a ratio of 1:1, that is, with S2 closed for 50% of the switching cycle time, the output voltage Vo is twice the input voltage $V_{in}$. The ratio 1:1 is held constant for the switching operations, which occur many times within the cycle of the input AC voltage. As a typical example, a switching frequency of 20 KHz is suitable for a fundamental input freqency of 50 or 60 Hz. At present it is considered that the practical lower limit of switching frequency is 5 times the fundamental frequency of the input AC signal and the practical upper limit is in the megahertz region. The lower limit is determined by the smoothness required for the output voltage. FIG. 2A shows a possible relationship between input and output, and FIG. 2B indicates that the value of the switching mark-space ratio is constant throughout the AC input cycle.

The use of the citcuit as a regulator will now be described with reference to FIG. 1. A feedback path is provided from the load $R_L$ to one input of a comparator. The other input of the comparator is connected to a voltage reference generator, VR. The output of the comparator is connected to a control unit, CU, which controls the switching characteristics of the switches, S1 and S2. In operation as a voltage regulator, the circuit is responsive to variations in the input voltage, $V_{in}$, or demands of the load. Any change in voltage across the load $R_L$ is compared with the voltage produced by reference generator VR. An output is produced which is fed to the control unit CU which changes the characteristics of the switches S1 and S2 and the output voltage across $R_L$ returns to the desired value. As hereinabove mentioned, it is preferred that the switching frequency be at all times constant and that the change in switching characteristics be achieved by varying the mark-space ratio of the switches. In this case the control unit may comprise a fixed frequency oscillator with two outputs of mutually complementary mark-space ratios, the mark-space ratios being responsive to changes in voltage fed from the comparator. The comparator may include rectifying and smoothing means such that the alternating voltage across $R_L$ may be compared with a D.C. voltage level from VR. For use as a current regulator, the circuit may be modified by deriving the voltage to be compared from the terminals of a resistance small in comparison with $R_L$ and connected in series with $R_L$. Any variation in current will thus show as a variation in voltage across the small resistance and the remainder of the circuit operates as hereinbefore described.

Figure 3A:
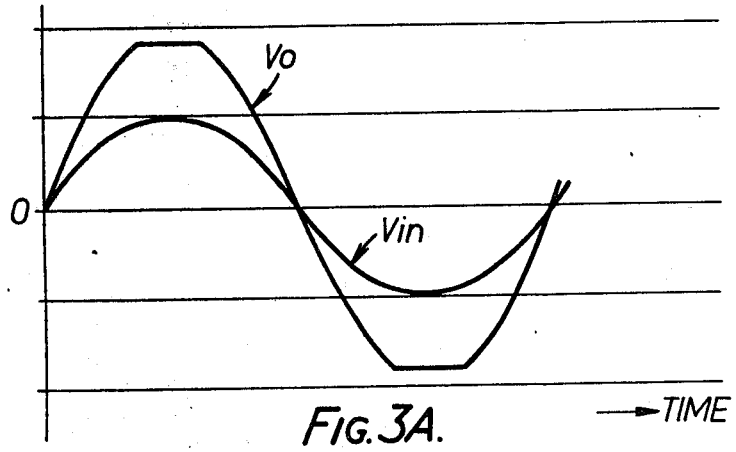
Figure 3B:
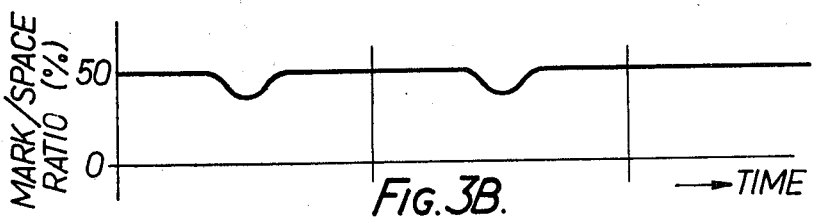

It is also possible to vary the mark-space ratio within the AC input cycle, to obtain an output voltage that has a waveform different from that of the input as long as the instantaneous output voltage is greater than the input voltage. FIG. 3A is a simple example of such an arrangement, and FIG. 3B shows the variation of the switching mark-space ratio.

When the regulator is operated with loads with leading or lagging power factor it is possible for the instantaneous load current to be in opposition to the input and output voltages during part or all of the cycle; for example, with an inductive lagging power factor load, during the first part of a positive halfcycle the load current will still be returning to the supply. It is important therefore that the switches S1 and S2 should be bilateral, that is, able to conduct in either direction. This is necessary not only because of the positive and negative polarity of the input voltage Vi but also as demanded by such a load. For this reason both current paths of the bi-directional switches S1 and S2 are switched on and off together and the direction of current flow is determined by the external voltage and current levels.

Figure 4:
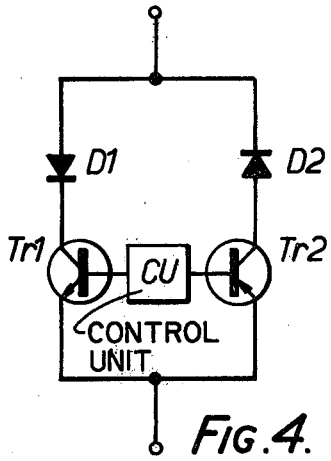
FIGS. 4 and 5 are circuits of examples of switching devices.
Figure 5:
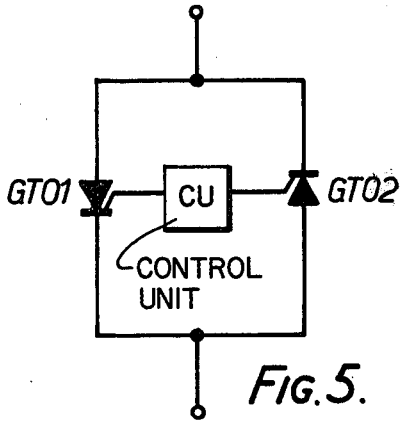

Examples of switching devices that can be employed are shown in FIGS. 4 and 5. FIG. 4 comprises two transistors TR1 and TR2, of different conductivity types. The collector currents of the two transistors are controlled by the voltages applied to the bases of the transistors. By using diodes D1 and D2 in series with the transistors appropriately connected as shown, the transistors are protected against high reverse voltages. FIG. 5 shows two gate turn off thyristors GTO1 and GTO2, oppositely connected in parallel. Control voltages are applied to the gates.

Figure 6:
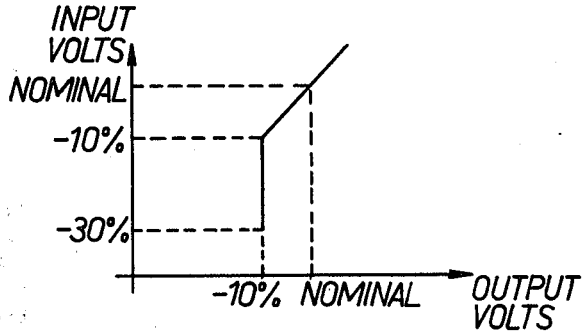
FIG. 6 is a regulation characteristic.

One of the applications for the regulator described is for compensating what are known as "brownout" conditions. These are conditions when the AC mains voltage is substantially below its normal level, say—20 or 30%, due to supply inadequacy or excessive consumer demand. For this service, the circuit of FIG. 1 can be designed to given an input-output relationship shown in FIG. 6. For input voltages within, say,—10% of normal, the input-output curve is linear, i.e., S1 is on continuously, and the output voltage follows input variations. When the input voltage falls by more than 10%, S1 and S2 are switched with mark-space ratios being functions of the voltage drop, and the output is held at a value 10% below normal.

What is claimed is:

1. In a regulator apparatus including a pair of input terminals adapted for connection with an alternating-current voltage source having a first frequency, and a pair of output terminals adapted for connection with a load; the invention which comprises (a) inductance means ($L_1$) connected at one end with one input terminal;

(b) first bilateral switch means ($S_1$) connecting the other end of said inductance means with one of said output terminals;

(c) second bilateral switch means ($S_2$) connected at one end between said inductance means and said first switch means, the other end of said second switch means being connected with the other input terminal;

(d) control means (CU) for switching said first and second switching means at a second frequency which is high with respect to said first frequency and for controlling the ratio of the periods of time for which said first and second switching means are conductive, said control means causing said switch means to be alternately bilaterally conductive at said second frequency to provide a bilateral conductive path through said first switch means during one part of a cycle of said second frequency and through said second switching means during another part of said cycle, whereby the voltage at said output is greater than or equal to the voltage of said voltage source.

2. An electric regulator as defined in claim 1, wherein said control means is responsive to a parameter of the output for controlling the ratio of the periods of time for which said first and second switch means are conductive, respectively.

3. An electric regulator as defined in claim 2, wherein said parameter is the regulator output voltage across said output terminals.

4. An electric regulator as defined in claim 1, and further including a capacitor connected in parallel across the output terminals.

5. An electric regulator as defined in claim 1, wherein said first frequency is in the range 50 to 60 Hz.

6. An electric regulator as defined in claim 1, wherein said second frequency is at least five times the first frequency.

* * * * *